US007621496B2

(12) United States Patent
Cancilliari et al.

(10) Patent No.: US 7,621,496 B2
(45) Date of Patent: Nov. 24, 2009

(54) HANGING STORAGE TRAY

(76) Inventors: Alison P. Cancilliari, 29235 Lowell St., Gibralter, MI (US) 48173; Dino M Cancilliari, 29235 Lowell St., Gibralter, MI (US) 48173; Michael D. Baldwin, 30953 Island Dr., Gibralter, MI (US) 48173; Michael I. Witucki, 29435 Evergreen St., Flat Rock, MI (US) 48134

( * ) Notice: Subject to any disclaimer, the term of this patent is extended or adjusted under 35 U.S.C. 154(b) by 373 days.

(21) Appl. No.: 11/621,794

(22) Filed: Jan. 10, 2007

(65) Prior Publication Data

US 2008/0164397 A1 Jul. 10, 2008

(51) Int. Cl.
*A47H 1/10* (2006.01)

(52) U.S. Cl. ..... 248/318; 211/85.29; 211/113

(58) Field of Classification Search ..... 248/318; 211/85.29, 113
See application file for complete search history.

(56) References Cited

U.S. PATENT DOCUMENTS

| | | | | |
|---|---|---|---|---|
| 942,714 | A | 12/1909 | Cromwell | |
| 2,631,735 | A | 3/1953 | Levesque | |
| 2,706,517 | A | 4/1955 | Dexter et al. | |
| 2,841,211 | A | 7/1958 | Thompson | |
| 2,897,976 | A | 8/1959 | Miller | |
| 2,979,120 | A | 4/1961 | Amburn | |
| 3,207,321 | A | 9/1965 | Joyce | |
| 3,291,521 | A | 12/1966 | Krueger | |
| 3,534,866 | A | 10/1970 | Asenbauer | |
| 3,647,112 | A | 3/1972 | Limbert, Jr. | |
| 3,986,649 | A | 10/1976 | Heimstra | |
| 4,449,750 | A | 5/1984 | Pultman | |
| 4,491,257 | A | 1/1985 | Ingles | |
| 4,624,502 | A | 11/1986 | Boole | |
| 4,861,059 | A | 8/1989 | Shirk | |
| 4,869,385 | A * | 9/1989 | Blinsinger | 220/4.01 |
| 4,946,058 | A | 8/1990 | Stamm | |
| 5,704,527 | A * | 1/1998 | Struzer | 224/547 |
| 6,170,680 | B1 | 1/2001 | Hung | |
| D451,054 | S | 11/2001 | Thom et al. | |
| D481,894 | S | 11/2003 | Hunt | |
| D487,845 | S | 3/2004 | Johansson et al. | |
| D517,319 | S | 3/2006 | Wisnoski et al. | |
| 2005/0189308 | A1 | 9/2005 | Warner et al. | |

FOREIGN PATENT DOCUMENTS

| | | |
|---|---|---|
| JP | 06-296531 A | 10/1994 |
| KR | 20-0355173 | 7/2004 |

* cited by examiner

*Primary Examiner*—J. Allen Shriver, II
*Assistant Examiner*—Bradley H Duckworth
(74) *Attorney, Agent, or Firm*—Harness, Dickey & Pierce, P.L.C.

(57) ABSTRACT

A lightweight, structurally strong, hanging storage tray adapted to be suspended from a conventional classroom chair, a ladder or other implement for holding various forms of articles. When used with a conventional classroom chair, the tray is well suited to store books, laptop computers, notebooks, 3-ring binders, etc. The tray can be easily attached or moved from a conventional chair or ladder without any tools or independent fastening elements. The tray is further shaped such that it is stackable with other trays when it is to be stored.

16 Claims, 8 Drawing Sheets

HANGING STORAGE TRAY

FIELD

The present disclosure relates generally to storage trays and, more particularly, to a hanging storage tray that is well adapted to be supported from a chair, a ladder or other implements, and that may be stacked for storage when not in use.

BACKGROUND

In classrooms and meeting rooms, four legged metal chairs are often employed. However, such chairs generally do not include any means for conveniently storing books, backpacks, laptops, or other items often carried by individuals. Some attempts have been made to attach a horizontal platform between the four legs of the chair. However, such trays often impede the stacking of typical classroom chairs which is often required when the chairs are stored, and typically do not allow for holding a plurality of large books, backpacks, and other larger items.

Accordingly, what is needed is some form of hanging storage device that may be conveniently and quickly attached and removed from a conventional four legged classroom chair, but that enables a plurality of books, a laptop, a backpack, or other like articles to be temporarily stored therein while the individual is seated in the chair. Such a hanging storage device must also not interfere with the legs of an occupant when the occupant is seated in the chair. Such a storage device must also not otherwise interfere with the balance or construction of the chair when the storage device is filled with typical articles such as books, a laptop, a backpack, etc.

It is also known that when working on an extension ladder, it is often necessary to have access to different tools or implements (e.g., drills, hand tools, painting or paint removal implements, etc.). However, many pre-existing storage implements for use with ladders to not offer a relatively large compartment for storing items and/or cannot be attached/detached from the ladder quickly and easily. Thus, it would also be highly desirable to provide some form of hanging storage implement that is well suited for use with a conventional extension ladder, and that can be attached and detached from an extension ladder quickly and easily with no special tools or independent fasteners being required.

SUMMARY

The present application is directed to a hanging storage tray that is especially well adapted for use with chairs and ladders. In one embodiment, the hanging storage tray has a main body portion, a neck portion extending from the main body portion, and a hook portion formed at a distal end of the neck portion. The hook portion is adapted to engage with a portion of the chair. The hook portion enables the entire tray to be quickly and easily attached to and removed from a chair as needed. The tray further does not interfere with the stackability of the chair.

In one embodiment, the main body portion and the neck portion of the tray are formed with a draft that enables multiple ones of the trays to be stacked together when the trays are not needed. This significantly saves space when the trays are not needed and are required to be stored away, such as in a storage room, closet, etc.

The tray may be constructed from various metals, but in one preferred form is molded from a suitably high strength plastic. The trays are light in weight and can be easily handled by an individual when the tray must be attached to or removed from a chair.

In various embodiments, the neck portion of the tray is formed so as to extend generally non-perpendicular to a bottom wall of the main body portion of the tray. This enables the main body portion of the tray to be held generally parallel to a floor when the neck portion is attached to a pair of legs of a conventional classroom chair, where the rear legs are positioned at an angle non-perpendicular to the floor. With this construction, the main body portion abuts the rear legs of the chair, which helps to stabilize the chair and maintain a center of gravity of the chair reasonably close to that which the chair would have if the tray was not attached to the chair.

In one embodiment, the hanging tray is especially well adapted for use with a conventional extension ladder. The hook portion may be quickly and easily placed over a wrung of a ladder such that the main body portion abuts a pair of longitudinal members of the ladder.

In one embodiment, the tray includes a lip portion formed along an upper edge of the main body portion to add additional rigidity and structural strength to the tray. The neck portion also includes a pair of ribs integrally formed therein that add to the structural rigidity of the neck portion. The hook portion may be integrally formed or attached by any conventional fasteners to the neck portion.

In its various embodiments, the hanging storage tray provides a lightweight, generally low cost, yet effective means for temporarily storing a wide variety of articles, such as books, writing tablets, laptop, computers, backpacks, etc. from a conventional classroom chair, or various other tools and work implements when it is used with a ladder.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
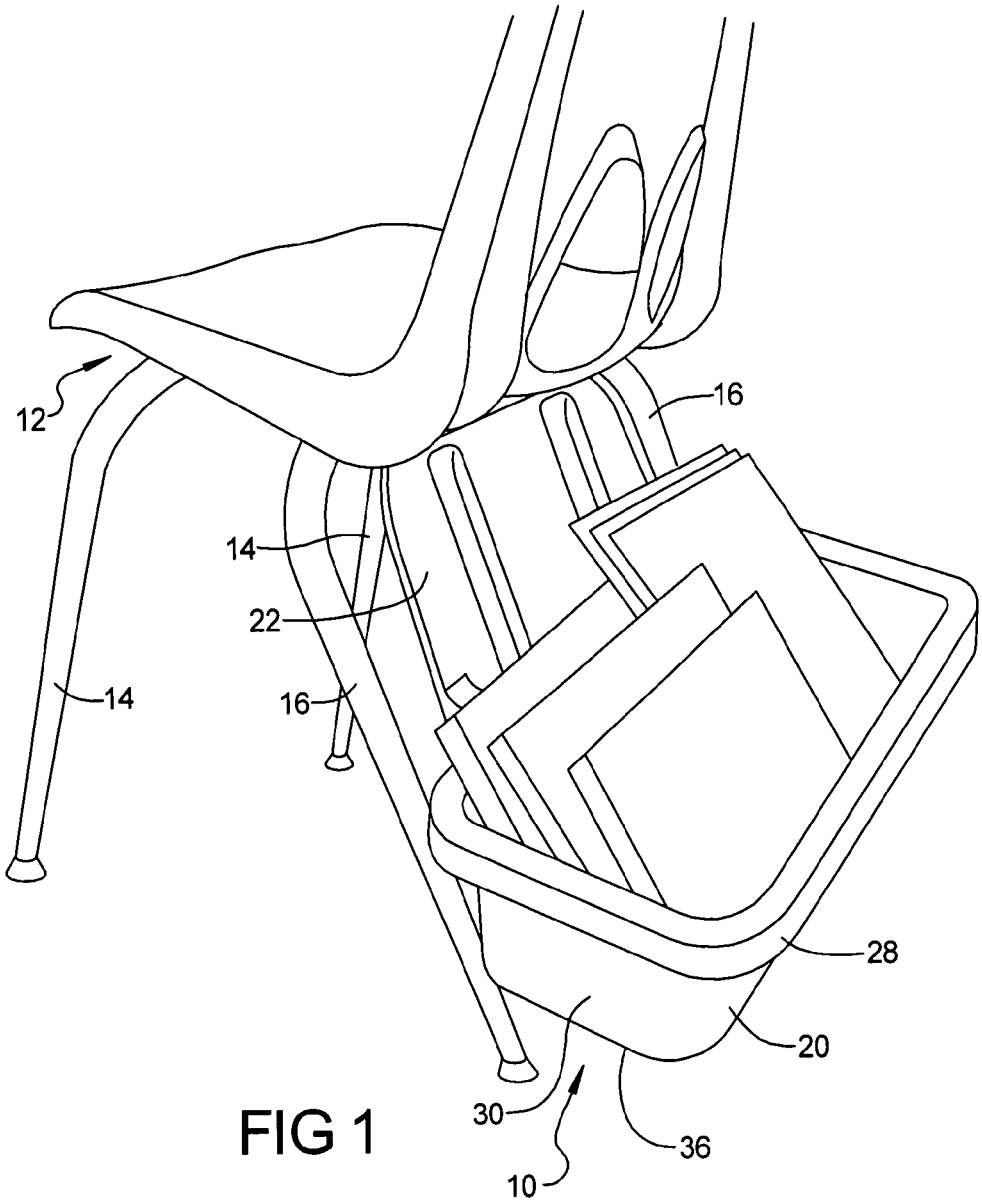
FIG. 1 is a perspective view of one embodiment of a hanging storage tray of the present disclosure attached to a conventional classroom chair.
Figure 3:
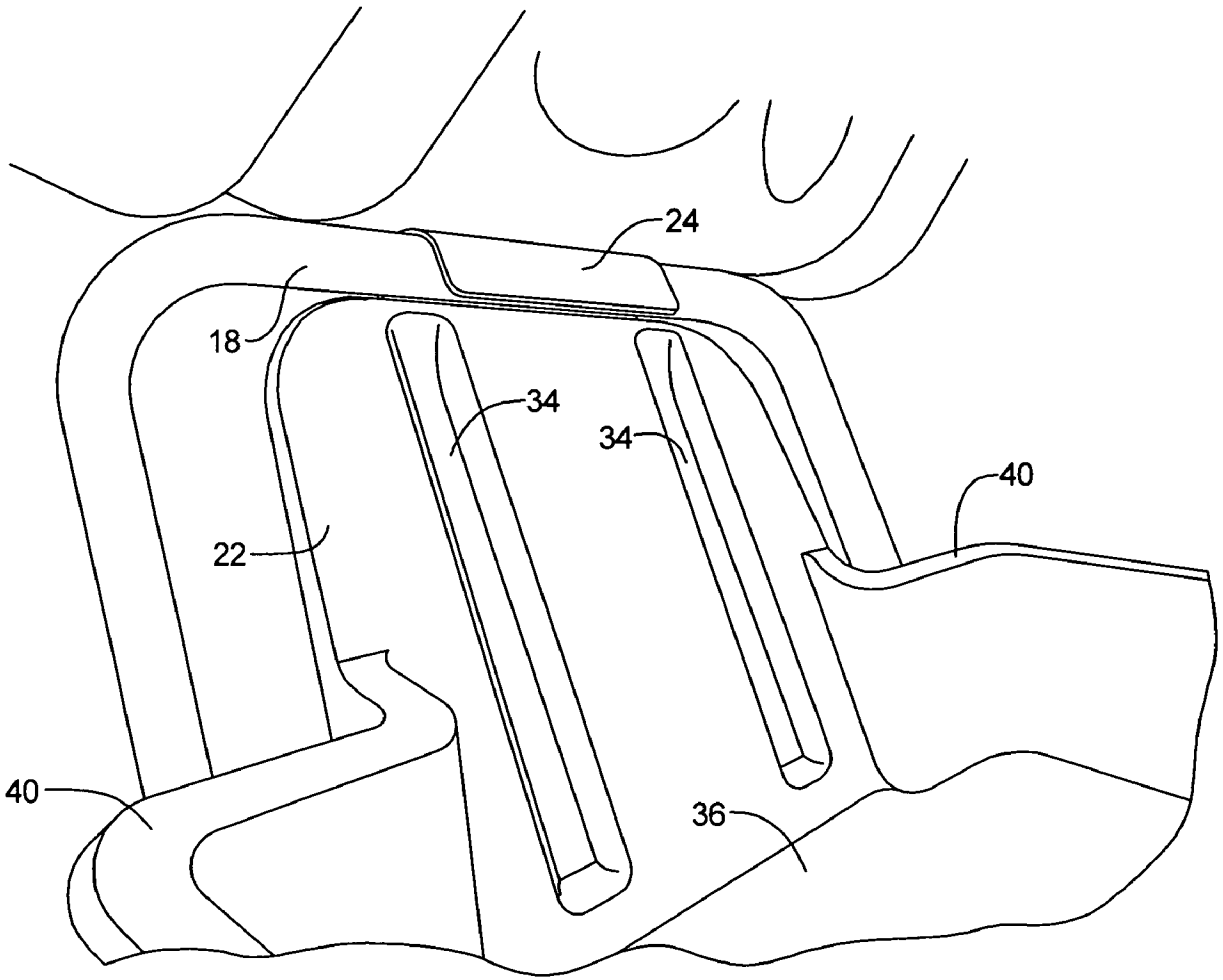
FIG. 3 is a perspective view of a portion of the hanging storage tray illustrating a hook portion thereof engaged with a center section of the pair of rear legs of the chair of FIG. 1.
Figure 4:
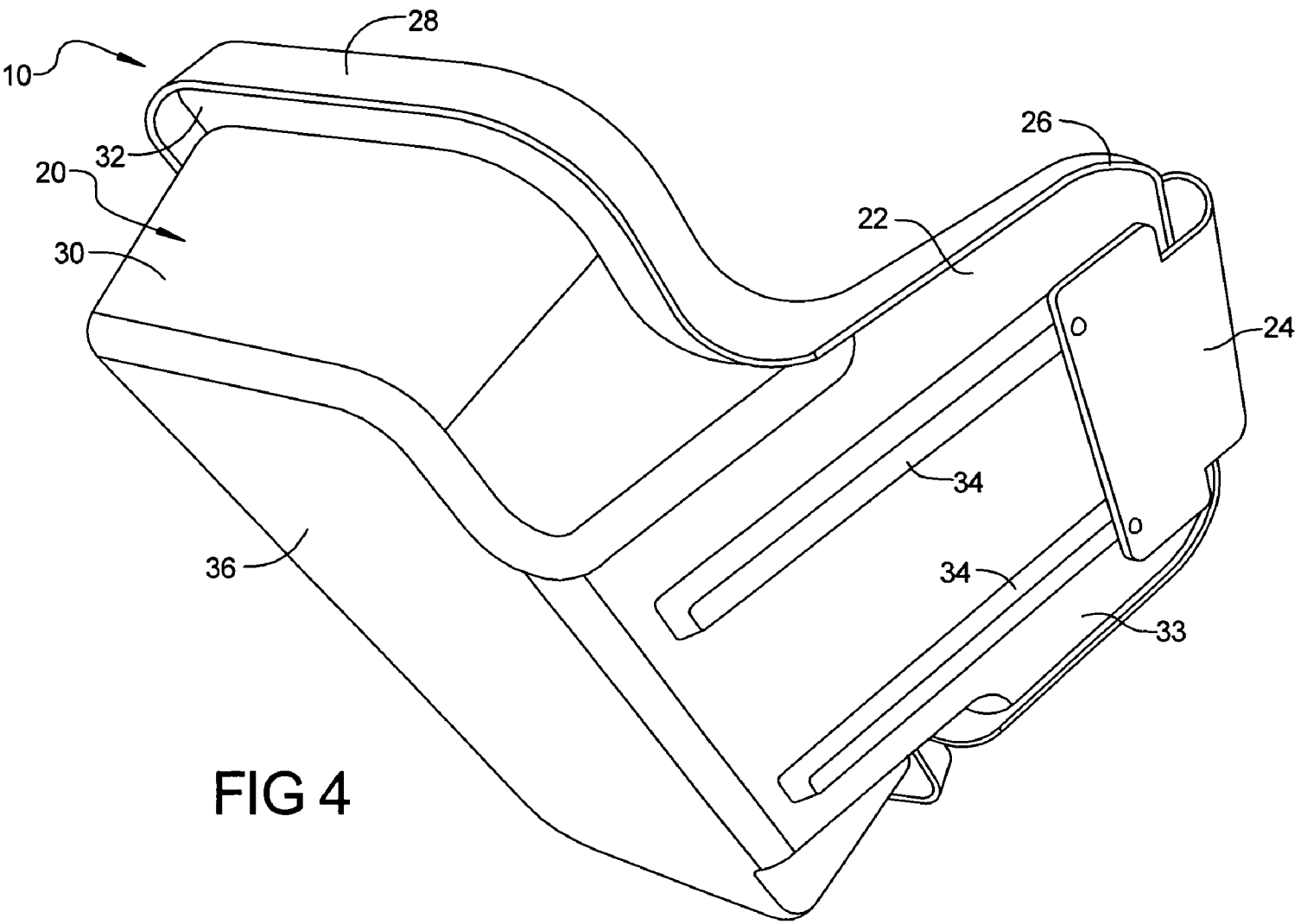
FIG. 4 is a perspective rear view of the hanging storage tray.

Referring to FIGS. 1, 3 and 4, a hanging storage tray 10 in accordance with one embodiment of the present disclosure is illustrated. The tray 10 is well adapted to be suspended from a conventional classroom chair 12 that has a pair of front legs 14, a pair of rear legs 16, and a center section 18 (FIG. 4) extending perpendicularly between the rear legs 16. It will be appreciated immediately, however, that the tray 10 can be used with a variety of other articles, for example a ladder, as will be described further in the following paragraphs. Thus, the tray 10 is not limited to use with only a conventional, four legged classroom chair. The tray 10 is also well adapted to be used with little or no modification with other styles of chairs.

With further reference to FIGS. 1, 3 and 4, the tray 10 includes a main body portion 20, a neck portion 22 extending from the main body portion 20, and a hook portion 24 (FIGS. 3 and 4) extending from distal end 26 of the neck portion 22. In this example, the main body portion 20 forms a generally rectangular shape when viewed in plan, although it will be appreciated that it could take other shapes, for example, an oval shape, if desired. Thus, the rectangular shape is meant to be exemplary only.

The main body portion 20 includes a folded lip portion 28 that is integrally formed with sidewalls 30 of the main body portion 20 adjacent an upper edge 32 of the sidewalls 30. The lip portion 28 extends about substantially the entire upper edge portion 32 of the main body portion 20, as well as around a perimeter portion 33 of the neck portion 22 (shown particularly well in FIG. 4). The lip portion 28 adds significant structural strength and rigidity to the main body portion 20, the neck portion 22 and thus to the overall tray 10. In this example, the neck portion 22 is also shown to include a plurality of integrally formed ribs 34 (FIGS. 3 and 4) which add further structural strength and rigidity to the neck portion 22.

Figure 2:
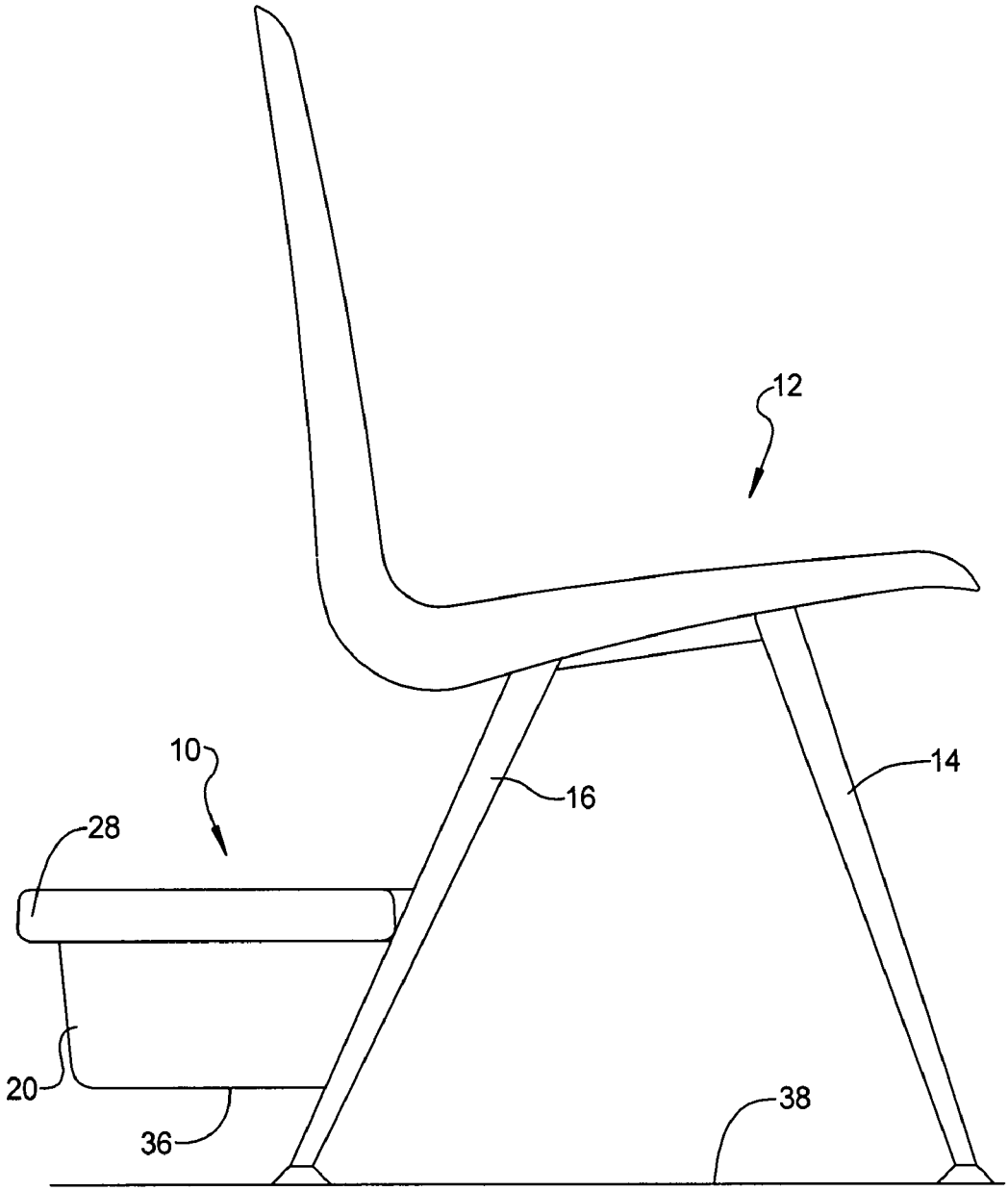
FIG. 2 is a side view of the chair and the hanging storage tray shown in FIG. 1.

The neck portion 22 has a width that is less than the width of the main body portion 20 so that the neck portion is able to rest between the rear pair of legs 16 when the tray 10 is attached via the hook portion 24 to the center section 18. This feature is illustrated in FIG. 2. The neck portion 22 is also formed to extend at an angle non-perpendicular to a bottom wall 36 of the main body portion 20 as best illustrated in FIGS. 1 and 2. Preferably, the angle at which the neck portion 22 extends from the bottom wall 36 comprises an angle of between about 105°-135°, and more preferably, an angle which matches the angle at which the rear pair of legs 16 extend relative to a floor 38 (FIG. 2) on which the chair 12 is resting. In this manner, the neck portion 22 rests between the rear pair of legs 16 and thus does not interfere with the legs of an occupant seated in the chair 12. By making the width of the neck portion 22 less than the width of the main body portion 20, and by making the width of the main body portion 20 at least about as wide as the spacing of the rear pair of legs 16, corner portions 40 of the main body portion 20 will abut the rear pair of legs 16 once the tray 10 is secured to the chair 12 via the hook portion 24 (FIG. 3). This abutting contact of the main body portion 20 relative to the rear pair of legs 16 further stabilizes the tray 10 against rotational movement once it is hung from the center section 18 of the chair 12. This construction also helps to maintain the center of gravity of the tray 10 as close to that of the chair 12 as practicable, which further adds to the stability of the chair 12. Thus, the chair 12 is not prone to tipping even when the tray 10 is loaded with a backpack, books, laptop, etc. and the chair 12 is unoccupied.

With specific reference to FIGS. 3 and 4, the hook portion 24 may be integrally formed with the neck portion 22 or may be secured to the neck portion 22 as an independent component via a plurality of rivets, threaded fasteners, adhesives or any other suitable means. In one form, the thickness of the hook portion 24 and its overall shape may be selected such that if a child steps into the tray 10 and attempts to stand in the tray, the hook portion 24 will bend to immediately release it from the chair 12.

The tray 10 may be formed from a variety of materials, but in one form is constructed from a relatively high strength plastic through an injection molding or blow molding process. One high strength plastic that is suitable for use is polypropylene.

Figure 5:
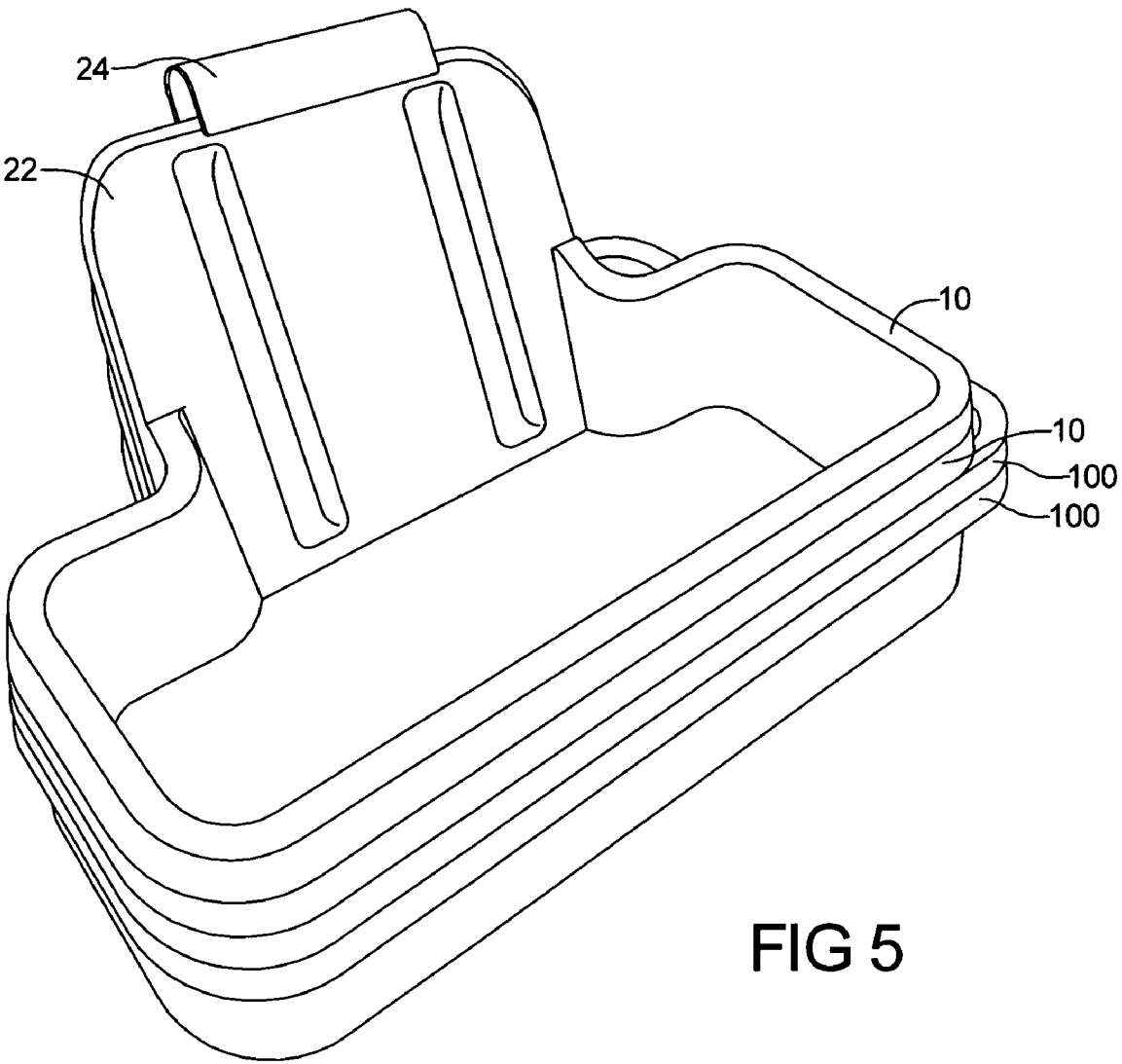
FIG. 5 is a perspective view illustrating a plurality of the hanging storage trays of FIG. 1 stacked together for storage.

A particular advantage of the tray 10 is that the main body portion 20 and the neck portion 22 are constructed with a draft (i.e., outward angling) that enables a plurality of trays 10 to be stacked together such as when the trays 10 are not needed for use. This is illustrated in FIG. 5. As will be appreciated, without this feature, storage of the trays 10 would require considerably more room for a given number of trays. However, it will be appreciated that the tray 10 could be formed without the draft, and thus without being "stackable", if this feature is not desired or needed.

The folded over lip 28 also enables the user to easily grasp the tray adjacent its upper edge 32 when securing or removing the tray 10 from the chair 12. The construction of the hook portion 24 enables the tray 10 to be quickly and easily manipulated into place and engaged with the center section 18 of the chair 12. An important advantage is that no special external tools are required for attaching the tray 10 to the chair 12, nor are any independent fasteners required for such attachment.

Another important advantage of the tray 10 is its relatively light weight. The light weight of the tray 10 further enables small adults or even children to handle and attach or remove the tray 10 as may be needed in a classroom environment. The angle of the neck portion 22 further serves to support tall folders, books, laptop computers, 3-ring binders, or other articles that may otherwise, because of their height, have a tendency to trip out of the tray 10. Such articles can be placed in an angled orientation within the tray 10, as illustrated in FIG. 1, to make use of the neck portion 22 as a supporting surface.

Figure 6:
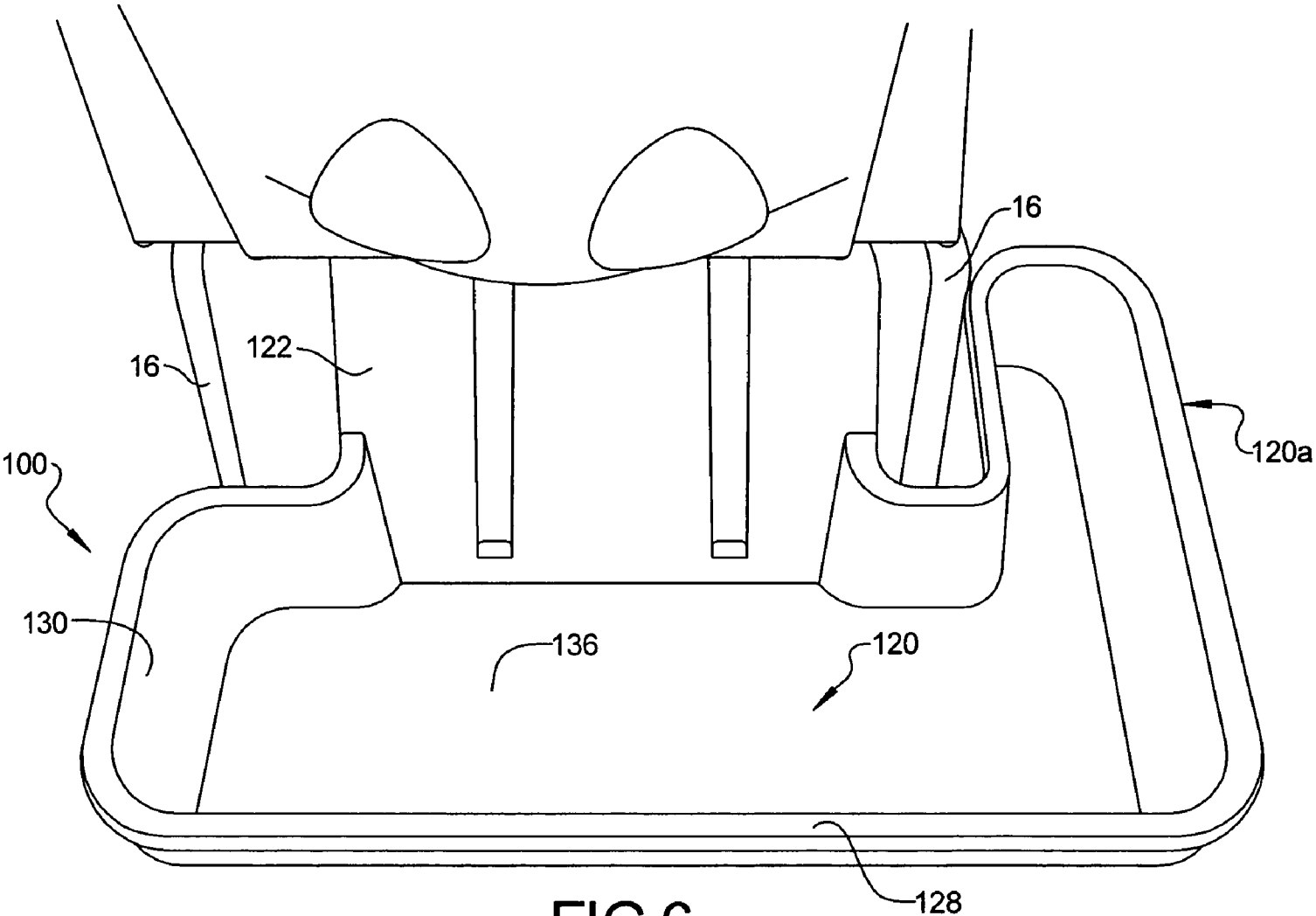
FIG. 6 is a perspective view of another embodiment of the hanging storage tray, in which a main body portion of the tray forms a L-shape that is especially well suited for storing a laptop computer.
Figure 7:
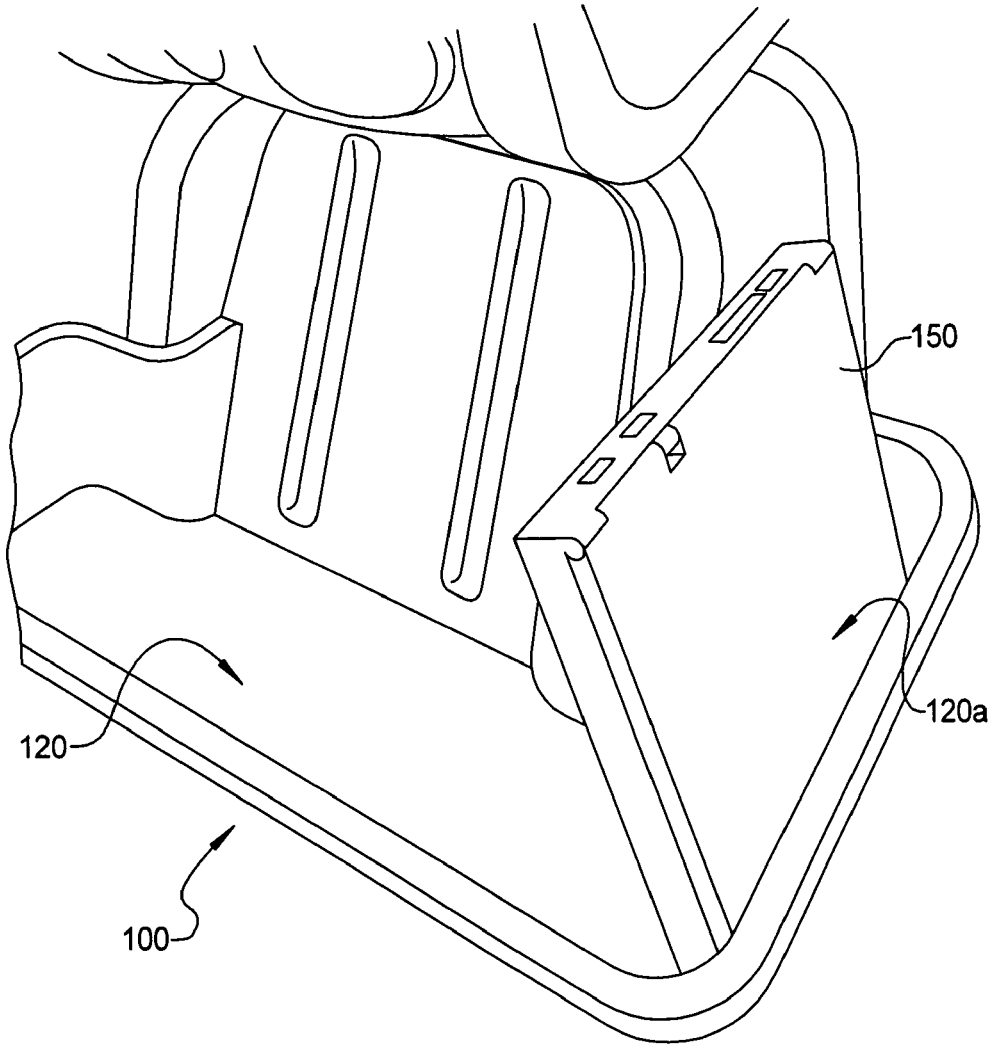
FIG. 7 is a perspective view of the tray of FIG. 6 illustrating a laptop stored therein.

Referring to FIG. 6, a tray 100 in accordance with another embodiment of the present disclosure is illustrated. The tray 100 is identical in construction to the tray 10 shown in FIG. 1, with the exception that the main body portion is formed with an L-shape when viewed in plan, rather than a rectangular shape. The L-shaped portion has been identified by reference numeral **120*a*. Portions of the tray 100 that correspond to tray 10 of FIG. 1 have been denoted by reference numerals increased by 100 over those used in connection with the description of tray 10. Portion 120*a* is especially well suited for supporting a laptop computer 150, as illustrated in FIG. 7, when the laptop computer is placed on one end thereof within the portion 120*a* of the main body portion 120 of the tray 100. This leaves the majority of the main body portion 120 of the tray 100 free for holding books, notebooks, or other articles. From FIG. 5, it will be appreciated that the different shapes of trays 10 and 100** do not prevent them from being stacked together for storage.

Figure 8:
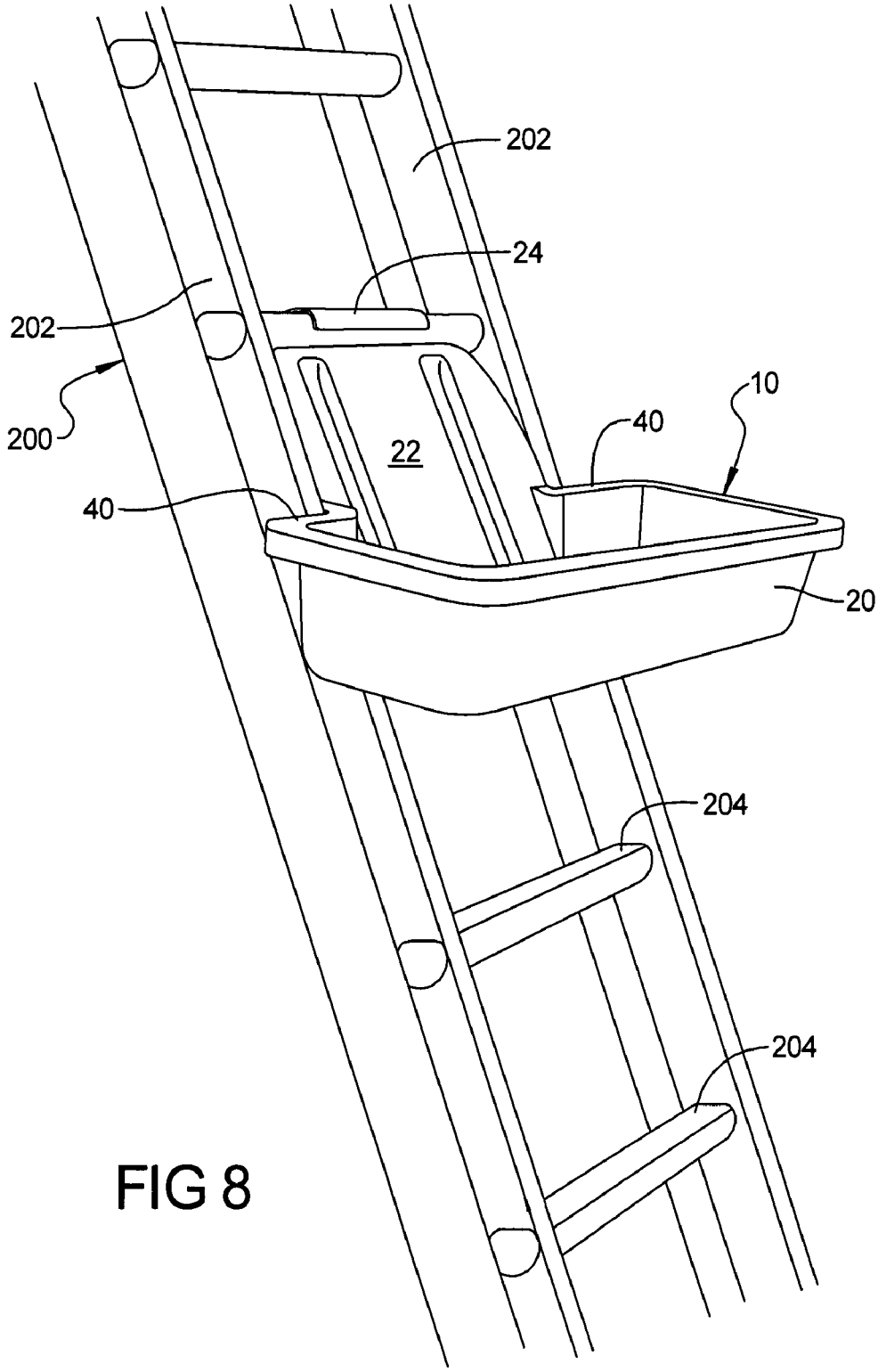
FIG. 8 is a perspective view of the hanging storage tray being used on a conventional extension ladder.

Referring to FIG. 8, the tray 10 is shown being suspended from a ladder 200. Ladder 200 includes longitudinal members 202 and a plurality of rungs 204. The hook portion 24 can be placed over one of the rungs 204 so that the tray 10 is suspended in a manner similar to that illustrated in FIG. 1. Thus, corner portions 40 engage the longitudinal members 202, while the neck portion 22 resides generally between the two longitudinal members 202. In this regard, if one desires to design the tray 10 for use with both a conventional classroom chair and a ladder, then the overall width of the neck portion 22 and the width of the main body portion 20 of the tray 10 will need to be selected such that the tray 10 is able to be suspended from either a rung of a typical ladder or from a particular style of chair (e.g., such as a conventional classroom chair).

While the tray 10 has been illustrated in FIG. 1 as being supported from the rear legs 16, it will be appreciated that the tray could be manufactured, with minor modifications, to be supported between the front legs 14. However, it is anticipated that the most convenient placement of the tray 10 will be immediately behind the rear legs 16 so as not to interfere with the legs of the chair occupant.

The various embodiments thus provide a means for conveniently, temporarily storing a wide variety of articles, such as books, laptop computers, back packs, writing tablets, notepads, 3-ring binders, etc., that are often carried by individuals to and from classrooms or meetings rooms. Alternatively, the various embodiments of the hanging storage tray can be used with any type of implement where it would be convenient to hang the tray therefrom, while the tray is being used to hold a variety of work implements. The various embodiments are further relatively inexpensive to manufacture, lightweight to handle, durable and easily stackable for storage purposes.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A tray adapted to be suspended from another implement, wherein the implement has a pair of legs extending non-perpendicular to a ground surface on which the implement is being supported, the tray comprising:

a main body portion for holding articles therein;

said main body portion including a pair of corner portions and a bottom wall;

a neck portion extending from the bottom wall of said main body portion at an angle of at least about 135 degrees from the bottom wall, and further having a width that is less than a width of the main body portion, so that said neck portion may extend between the pair of legs of the implement which the tray is suspended from, and such that the corner portions of the main body portion abut against the legs of the implement and maintain the bottom wall generally parallel to a ground surface on which the implement is resting;

a hook portion formed at a distal end of said neck portion, said hook portion shaped to enable it to engage a portion of said implement so that said tray can be suspended from said implement, with said corner portions of the main body portion of said tray abutting the legs of said implement to maintain said main body portion rotationally stable as articles are placed in and removed from said main body portion; and said tray being attachable and removable from said implement without the need for any external tools or independent fastening elements.

2. The tray of claim 1, wherein said main body portion includes a lip formed along an upper edge surface thereof to add structural strength and rigidity to said tray.

3. The tray of claim 1, wherein said neck portion extends from said tray at an angle that is approximately equal to an angle at which the pair of legs, that said tray abuts when suspended from said implement, extend, relative to the ground surface on which said pair of legs are supported.

4. The tray of claim 3, wherein said tray forms an L-shape.

5. The tray of claim 3, wherein said hook portion is fixedly secured to said neck portion.

6. The tray of claim 1, wherein:

said implement comprises a ladder;

said width of the neck portion is sufficiently narrow to fit between a pair of longitudinal members of said ladder;

said hook portion is shaped to engage with a rung of said ladder; and said neck portion and said main body portion cooperate to enable said corner portions of the main body portion to rest against said longitudinal members when said tray is suspended from said rung and said ladder is positioned for use, to thus stabilize said tray against rotational movement while in use suspended from said rung.

7. The tray of claim 1, wherein said main body portion and said neck portion are shaped with a draft that enables said tray to be stacked with additional ones of said tray, when not in use.

8. A tray adapted to be suspended from a chair, where the chair has four metal legs, with a rear pair of the legs being angled to extend non-perpendicular to a ground surface on which said chair is being supported, and having a center section extending perpendicularly between said rear pair of legs, the tray comprising:

a main body portion for holding articles therein, the main body portion including a bottom wall and a pair of corner portions;

a neck portion extending from the bottom wall of said main body portion at an angle of between about 105-135 degrees, and having a width that is less than a width of the main body portion;

a hook portion formed at a distal end of said neck portion, said hook portion shaped to enable it to engage with said center section of said chair so that said tray can be suspended from said chair while resting with said corner portions of the main body portion of said tray abutting said rear pair of legs of said chair, and with said neck portion disposed between the rear pair of legs, to maintain said main body portion rotationally stable as articles are placed in and removed from said main body portion, and to maintain the bottom wall approximately parallel to the ground surface on which the chair is resting; and said tray being attachable and removable from said center section of said chair without the need for any external tools or independent fastening elements.

9. The tray of claim 8, wherein said main body portion and said neck portion are each formed with a draft that enables said tray to be stacked with another said tray, when not in use.

10. The tray of claim 9, wherein said main body portion has an L-shape when viewed in plan, a portion of said main body portion being sized to receive a laptop computer when said laptop computer is positioned on an end thereof and in a closed orientation.

11. The tray of claim 10, wherein said main body portion includes a lip for adding structural strength and rigidity to said main body portion.

12. A tray adapted to be suspended from a chair, where the chair has four metal legs, with a rear pair of the legs being angled to extend non-perpendicular to a ground surface on which said chair is being supported, and said rear pair of legs having a center section extending perpendicularly between said rear pair of legs, the tray comprising:

a main body portion for holding articles therein, the main body portion including a bottom wall and a pair of corner portions;

a neck portion extending from the bottom wall of said main body portion and forming an integral extension of said main body portion, the neck portion extending at an angle non-perpendicular to the bottom wall; the neck portion having a width less then that of the main body portion, a hook portion formed at a distal end of said neck portion, said hook portion shaped to enable it to engage with said center section of said chair so that said tray can be suspended from said chair while resting with said corner portions of the main body portion of said tray abutting said rear legs of said chair, to maintain said main body portion rotationally stable as articles are placed in and removed from said main body portion and without interfering with the legs of an occupant of said chair, and further such that said bottom wall is maintained generally parallel to the around surface;

said main body portion and said neck portion being formed with a draft to permit stacking of said tray with additional ones of said tray for convenient storage; and said tray being attachable and removable from said center section of said chair without the need for any external tools or independent fastening elements.

13. The tray of claim 12, wherein said main body portion includes an integrally formed lip portion along an upper edge thereof for adding structural strength and rigidity to said tray.

14. The tray of claim 12, wherein said neck portion has a width narrower than a spacing of said rear legs of said chair to enable said neck portion to rest between said rear legs when said tray is suspended from said center section.

15. The tray of claim 14, wherein said neck portion includes at least one stiffening rib integrally formed therein.

16. The tray of claim 15, wherein said neck portion includes a pair of stiffening ribs integrally formed therein.

* * * * *